United States Patent [19]

Palau et al.

[11] Patent Number: 4,739,806

[45] Date of Patent: Apr. 26, 1988

[54] DEVICE FOR FORMING THE SHED IN A WEAVING LOOM

[75] Inventors: Joseph Palau, Duingt; Dario Bassi, Corbas, both of France

[73] Assignee: Etablissements Staubli-Verdol, Chassieu, France

[21] Appl. No.: 896,212

[22] Filed: Aug. 14, 1986

[30] Foreign Application Priority Data

Aug. 23, 1985 [FR] France ..... 85 12816

[51] Int. Cl.[4] ..... D03C 13/00; D03C 3/00; D03C 3/06

[52] U.S. Cl. ..... 139/455; 139/59; 139/65

[58] Field of Search ..... 139/59, 65, 455, 55.1, 139/319, 317, 320; 206/334

[56] References Cited

U.S. PATENT DOCUMENTS

| | | | |
|---|---|---|---|
| 3,103,953 | 9/1963 | Lauritsen | 139/455 |
| 3,240,235 | 3/1966 | Burgess | 139/317 |
| 4,427,114 | 1/1984 | Howell et al. | 206/334 |
| 4,515,186 | 5/1985 | Durville et al. | 139/455 |
| 4,563,722 | 1/1986 | Maroney et al. | 206/334 |
| 4,593,723 | 6/1986 | Griffith | 139/65 |

FOREIGN PATENT DOCUMENTS

| | | | |
|---|---|---|---|
| 516927 | 11/1954 | Belgium | 139/59 |
| 9342 | of 1891 | United Kingdom | 139/65 |

*Primary Examiner*—Harvey C. Hornsby
*Assistant Examiner*—Joseph S. Machuga
*Attorney, Agent, or Firm*—Dowell & Dowell

[57] ABSTRACT

This invention relates to a device for forming the shed in a weaving loom, wherein the elements which constitute the system for lifting the warp yarns are, from top to bottom, an electro-magnet, two blades, two mobile hooks and a lifting beam. These elements are disposed one below the other between two vertical separating partitions constituting an assembly. A certain number of assemblies are assembled in a row so as to form a module which may be selectively inserted within the loom frame.

5 Claims, 5 Drawing Sheets

DEVICE FOR FORMING THE SHED IN A WEAVING LOOM

BACKGROUND OF THE INVENTION

1. Field of the Invention

The present invention relates to a device for forming the shed of a weaving loom.

2. History of the Art

It is known that, in order to open the shed of the layer of warp yarns of a weaving loom, a mechanism is used which is adapted to lift a certain number of these yarns while leaving the others at their lower level so as to allow the passage of a pick.

Shed forming devices are generally composed of hooks coupled to a heddle and which are lifted and lowered by griffe boxes, a selection being made from a card to determine whether or not the hooks are gripped by the griffe boxes.

Systems also exist wherein each harness cord is associated with the first pulley of a lifting beam which comprises a second pulley surrounded by a funicular member of which the ends are fast secured with two hooks which are continually displaced vertically in reciprocal manner in opposite directions by means of appropriate devices such as knives. When it is desired to lift a harness cord, one of the mobile hooks is gripped when, at its top dead centre, by a retaining hook generally actuated by an electro-magnet. Such a device is described in German Patent Application No. 2 204 815 withdrawn since June 1974. The different elements of the shed forming devices of the type described in that Patent Application are free in space, this leading to a large number of drawbacks. The mobile hooks associated with the ends of the funicular element are firstly in the isolated state, with the result that, if a harness cord breaks, it is very difficult to replace, all the more so as it is remote from the edge of the device in question.

It is also observed that the lifting beam, i.e. the system with two pulleys of which one is partially surrounded by the funicular element ensuring connection between the two mobile hooks, while the other cooperates with the harness cord, is subjected to parasitic movements. A pendulum movement is very often observed of the lifting beam, as well as its tendency to rotate. These different drawbacks have led to a limitation of the number of harness cords used on the known high-speed machines.

There again, a break of the funicular element brings about a drop of the lifting beam and its harness cord.

OBJECT OF THE INVENTION

The object of the improvements forming the subject matter of the present invention is to overcome the drawbacks set forth hereinabove and to produce a shed forming device in a weaving loom which can include a large number of systems for lifting the warp yarns.

To this end, the device according to the invention is essentially characterized in that the elements of each system, i.e. the retaining hooks with their selection device, the mobile hooks and the lifting beam, are disposed between two vertical partitions connected to each other so as to form a compact, independent assembly.

According to a particularly advantageous embodiment, a certain number of assemblies are assembled side by side so as to constitute a module which may easily be removed or returned into position in the event of mishap in place of any other, since it is pre-adjusted so as to be readily replaceable.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
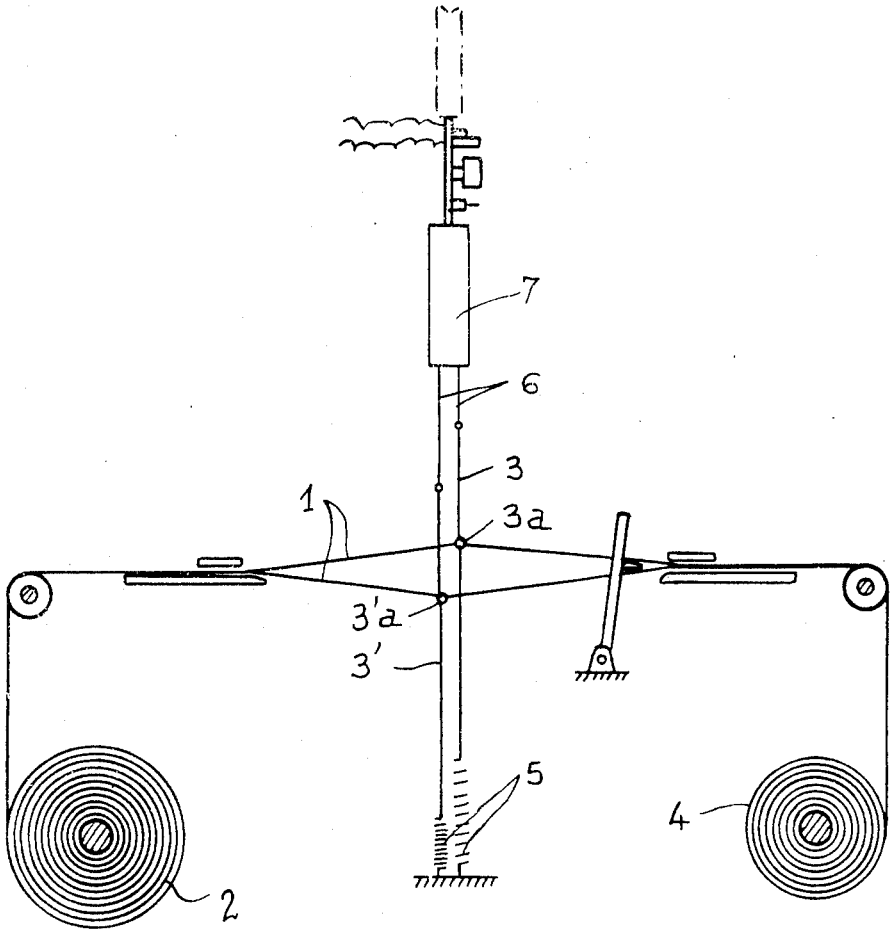
FIG. 1 is a schematic view illustrating a shed forming device in a weaving loom in the form of a module made according to the invention and intended to control two heddles only.

Referring now to the drawings, FIG. 1 schematically illustrates a layer of warp yarns 1 disposed in a weaving loom and which comes from a beam 2. Each warp yarn passes in the mail 3*a* of a heddle 3 adapted to open the shed to allow the passage of a pick with a view to forming a fabric which is wound on a reel 4. In the example shown, it is assumed that there are only two heddles 3, or only two groups of heddles, some being in high position and the others in low position. Reference 3' designates the heddle in low position and reference 3 the one in high position. The lower ends of each heddle are connected to the frame by traction springs 5, while their upper ends are each secured with harness cords 6. The harness cords are lifted and lowered by means of a shed forming device referenced 7.

The shed forming device 7, in the case of the present invention, includes a funicular member 8 (see FIGS. 2–7) with each of the ends of which a hook 9 is associated. These hooks include a lateral nose element cooperating with a knife 10 which is vertically and reciprocally moved in a manner which is well known. The funicular element 8 passes partially around the first pulley 11 of a lifting beam 12 of which the second pulley 13 supports a harness cord 6. The end of the harness cord opposite that which is connected to the heddle 3 is anchored to a fixed point 14 relative to the frame of the machine. The upper part of device 7 is provided with retaining hooks made in the form of flexible blades 15 associated in manner known per se with a single electro-magnet 16. The electro-magnet is adapted to vary the position of the blades so that the blades are displaced towards the centre of the device when the electro-magnet is energized in order that the curved ends 15*a* thereof may grip one or the other of, or both hooks 9.

Figure 2:
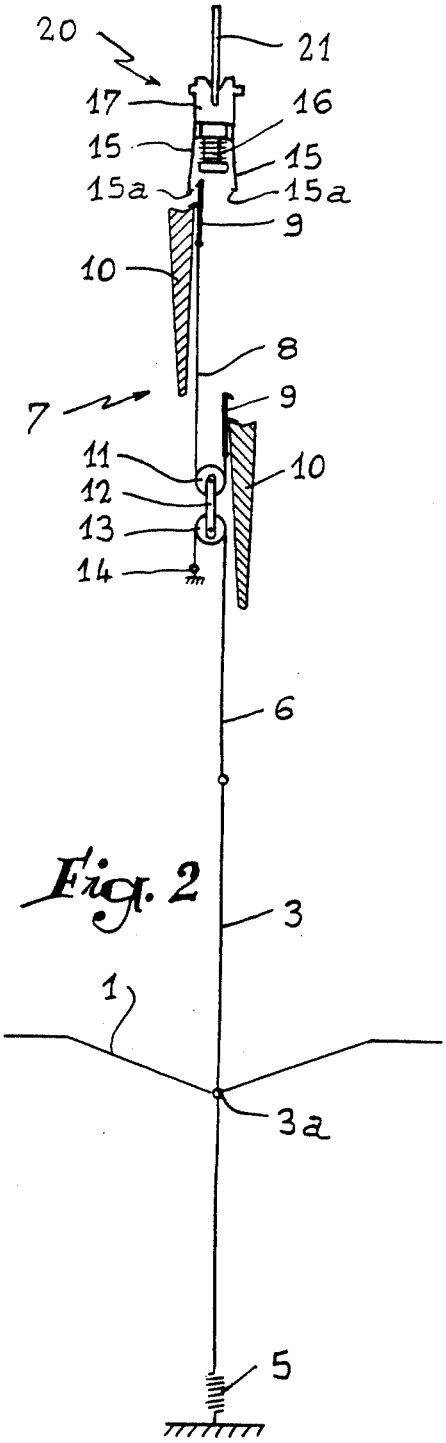
FIGS. 2 to 5 illustrate the conventional operation of a shed forming device of which each harness cord is associated with a funicular element provided with two hooks moving vertically in reciprocal movement.
Figure 3:
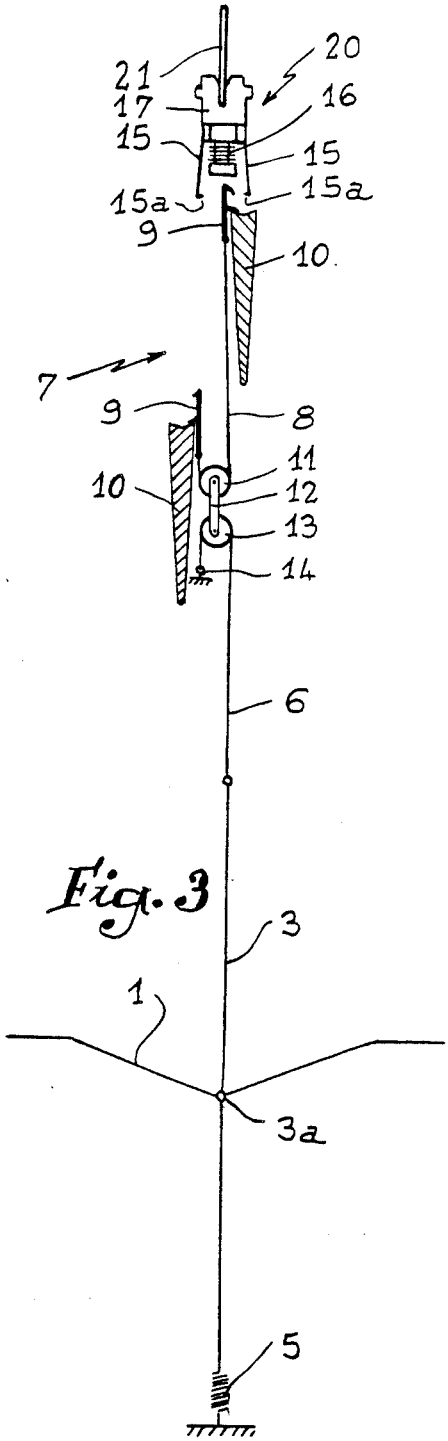
Figure 4:
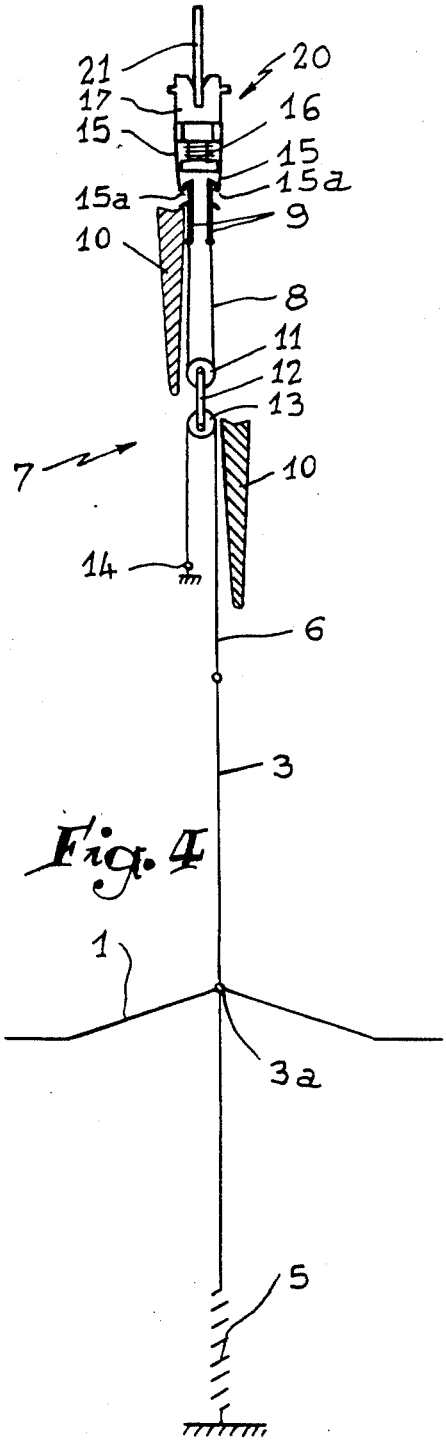
Figure 5:
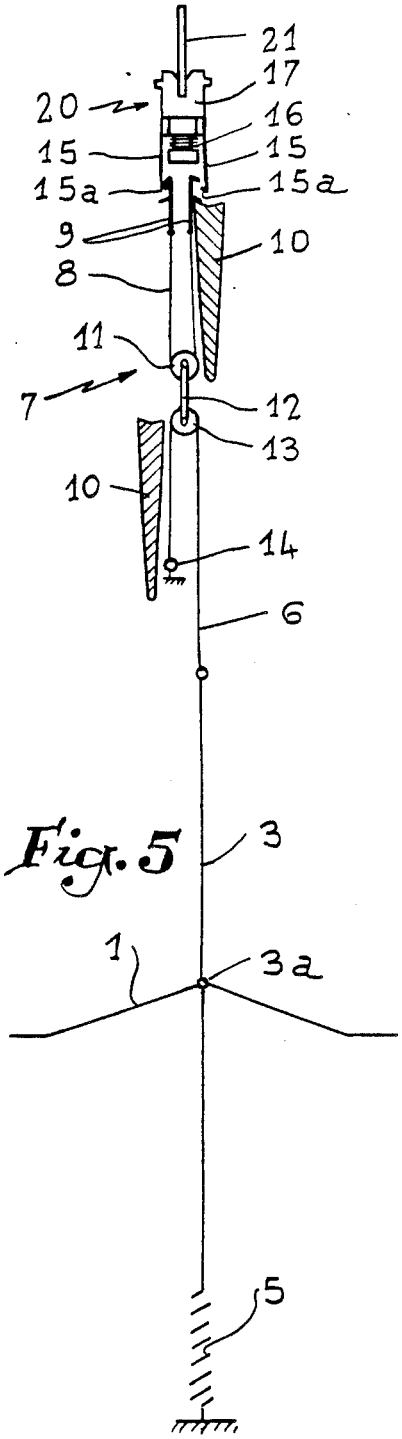

In FIG. 2, the electro-magnet 16 is not energized, with the result that hooks 9 are lifted and lowered without being gripped by the curved blades 15 so that the corresponding warp yarn remains in its low position. FIG. 3 illustrates the reverse position of the mobile hooks which changes nothing in the positioning of the heddle and corresponding warp yarn since the lifting beam remains in stable position.

If, in the position of the mobile hook of FIG. 3, the electro-magnet 16 is energized, the two blades are attracted so that, when the corresponding knife descends, the hook in question remains in high position, so that blade 10 redescends without the corresponding hook. When the other blade rises, the lifting beam 12, as well as the harness cord and heddle in question will rise, arriving in the position of FIG. 4 in which the two mobile hooks remain in high position with the result that the corresponding warp yarn remains lifted in open shed position.

In order to lower the warp yarn from its high position, the energy to the electro-magnet is cut off, with the result that the two blades move away from its core. One of the hooks is gripped by the first knife which arrives at its level and provokes its descent while the other remains hooked to the curved blade 15. When the other knife arrives at the level of the hook which remained in a high position, it unhooks it from the curved end 15*a* of the blade 15 so that the position illustrated in FIG. 2 is resumed, wherein the nose element of the hook engages with knife 10.

It is unnecessary to describe the operation of such a shed forming device further, as it is well known in the art.

To facilitate understanding, the assembly of the elements controlling a harness cord, i.e. the electro-magnet 16, the two curved elastic blades 15, the two mobile hooks 9 with their funicular element 8 as well as the lifting beam 12, will be referred to in the present specification as a "system".

According to the invention, each system described hereinabove is placed between two separating partitions 17 (see FIGS. 6 and 7), connected together at the level of their head 17*a* and their lower part 17*b*. Moreover, spacers 17*c* ensure the spaced apart relationship of two adjacent separating partitions, allowing passage of the mobile hooks 9. A compact and independent assembly is thus formed.

It will be noted that each separating partition 17 is provided with an oblong opening 17*d* constituting a guide for the lifting beam 12 which comprises two side elements 12*a* each engaging in an opening 17*d*.

The head 17*a* of each separating partition 17 is provided with two shoulders 17*e* adapted to rest on two crosspieces 18 of the device 7.

It is observed that the lower part 17*b* of the separating partitions 17 comprises a notch 17*f* enabling it to overlap a third retaining crosspiece 19 or vice versa.

Figure 6:
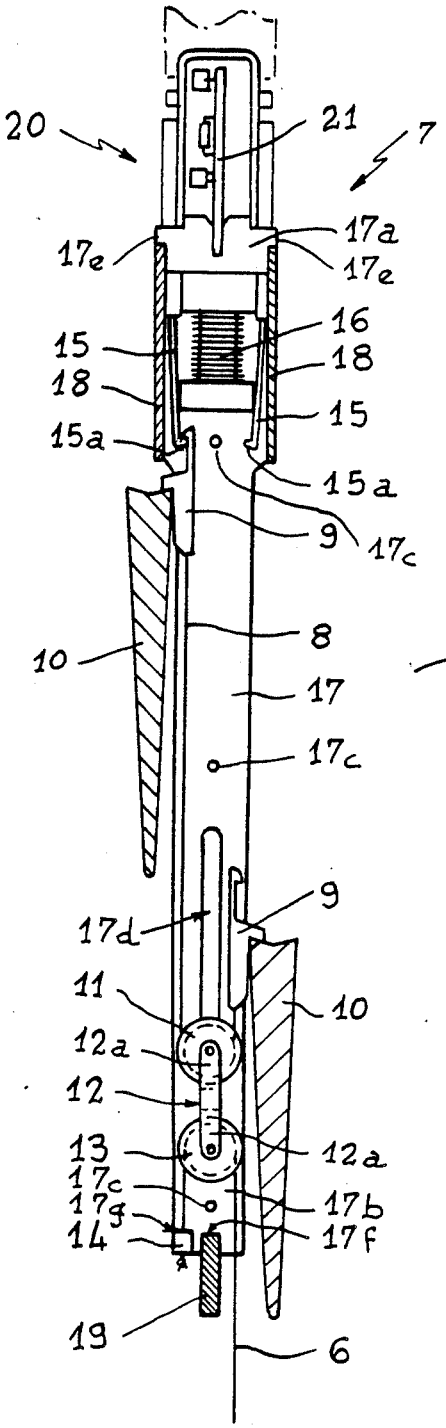
FIG. 6 is a transverse section showing the arrangement of the elements of each system for controlling the harness cords between two separating partitions.
Figure 7:
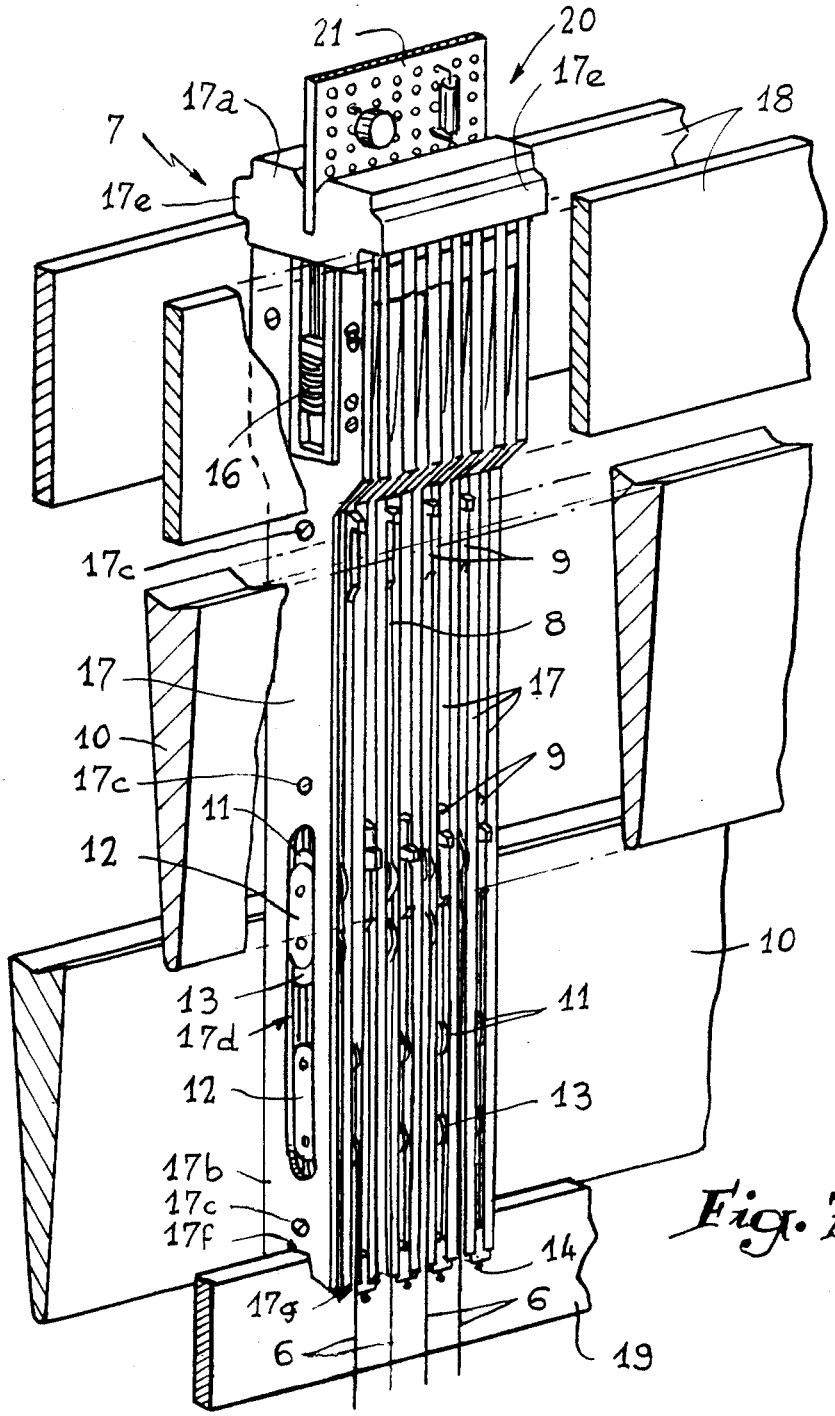
FIG. 7 shows in perspective a module made in accordance with the invention.

As illustrated in FIG. 7, a certain number of independent assemblies such as the one illustrated in FIG. 6 are assembled together so as to form a module 20 comprising for example six to ten assemblies, this figure not being limiting. The module supports a board 21 incorporating the circuit for energizing the corresponding electro-magnets. The board is plugged into complementary plugs borne by devices 7 and which have not been shown in the drawings.

By the manner in which it is designed, each module 20 may be removed for maintenance or repair purposes in simple manner and in a very short time. It is obvious that a module is returned into position under the same conditions by the cooperation of its retaining means 17*e*, 17*f* with crosspieces 18, 19.

It is observed that, in FIGS. 6 and 7, that end of the harness cord 6 opposite the one associated with the heddle is engaged in a notch 17*g* made in the base of each separating partition in order to be wedged therein, for example by means of an endpiece overmoulded on the corresponding end of the heddle.

It must, moreover, be understood that the foregoing description has been given only by way of example and that it in no way limits the domain of the invention which would not be exceeded by replacing the details of execution described by any other equivalents. It goes without saying that the modules may be disposed in any orientation, the knives having a corresponding direction of displacement.

What is claimed is:

1. Device for forming the shed in a weaving loom wherein the device is mounted relative to a heddle which is vertically reciprocally movable with respect to the loom frame comprising, an assembly, said assembly including a plurality of partition means having upper and lower ends, spacer means extending between and connecting said partition means in spaced, opposing, generally parallel and tandem relationship with respect to one another, a plurality of lifting beams, said lifting beams being disposed between and movable with respect to opposing pairs of said partition means, each of said lifting beams including first and second pulleys which are positioned between said opposing pairs of said partition means, guide means for positively guiding each of said lifting beams and first and second pulley means vertically between said partition means and inwardly of the upper and lower ends thereof, a plurality of funicular elements, said funicular elements extending partially around said first pulleys, each of said funicular elements having first and second ends, a plurality of harness cords, said harness cords extending partially around said second pulleys, each of said harness cords having first and second ends, a pair of mobile hook means connected to said first and second ends of each of said funicular elements, each of said mobile hook means being reciprocally movable between an upper and lower position, electro-magnet means mounted between said upper ends of opposing pairs of said partition means, each of said electro-magnet means having a pair of spaced elastic blade members which are selectively engageable with said mobile hook means when said mobile hook means are in said upper position, whereby when energizing means are mounted to said upper ends of said partition means said electro-magnetic means may be selectively energized.

2. The device of claim 1 in which each of said partition means includes a notch in the lower end thereof and a pair of outwardly extending shoulders along the upper end thereof for supporting said assembly relative to the loom frame.

3. The device of claim 1 in which each of said guide means includes an oblong opening in each of said partition means in which one of said lifting beams is guidingly received.

4. The device of claim 3 in which said first end of said harness cords is fixed to said lower end of one of said partition means, and said second end of said harness cords is fixed to the heddle.

5. The device of claim 4 including a lower and a pair of upper crosspiece support means mounted to the loom frame, each of said partition means including a notch in said lower end thereof and a pair of oppositely and outwardly oriented shoulders along the upper end thereof, said notches of said partition means being seated over said lower crosspiece support means and said pairs of upper crosspiece support means engaging said oppositely oriented shoulders of said partition means.

* * * * *